United States Patent [19]

Nakayama et al.

[11] Patent Number: 4,992,062

[45] Date of Patent: Feb. 12, 1991

[54] ELECTRICAL CONNECTION DEVICE

[75] Inventors: Makoto Nakayama; Shoichi Mochizuki, both of Gotenba, Japan

[73] Assignee: Yazaki Corporation, Japan

[21] Appl. No.: 467,250

[22] Filed: Jan. 19, 1990

[30] Foreign Application Priority Data

Jan. 24, 1989 [JP] Japan ..... 1-5989[U]

[51] Int. Cl.[5] ..... H01R 13/68

[52] U.S. Cl. ..... 439/621; 439/842; 439/861

[58] Field of Search ..... 439/620, 621, 622, 816, 439/818, 842, 845, 846, 849, 850, 858, 861, 862, 792, 441

[56] References Cited

U.S. PATENT DOCUMENTS 4,133,595 1/1979 Pritulsky ..... 439/441

4,552,425 11/1985 Billman ..... 439/842

*Primary Examiner*—David L. Pirlot

*Assistant Examiner*—Hien D. Vu

*Attorney, Agent, or Firm*—Venable, Baetjer and Howard

[57] ABSTRACT

An electrical connection device comprises a terminal connector (1*d*) including a terminal guide (4*d*), a resilient strip (3*d*) formed continuous to the terminal guide to be located opposite to one of the surfaces of the terminal guide and a terminal support (6*d*) located opposite to the other surface of the terminal guide, a tab-shaped terminal (10*d*) of a bus bar to be electrically connected with the resilient strip (3*d*), and a tab terminal (12*d*) of a fuse to be electrically connected with the terminal support (6*d*). In the device, the tab-shaped terminal (10*d*) of the bus bar is formed with at least one electrical-contact surface projection (11*d*) projecting toward the terminal guide (4*d*) of the terminal connector (1*d*), and the terminal guide (4*d*) of the terminal connector is formed with a cutout (7*d*) for receiving the surface projections (11*d*) and permitting outward protrusion of the surface projection toward the terminal guide (4*d*), whereby the surface projection (11*d*) of the tab-shaped terminal of the bus bar makes direct electrical contact with the tab terminal (12*d*) of the fuse.

2 Claims, 3 Drawing Sheets

ELECTRICAL CONNECTION DEVICE

BACKGROUND OF THE INVENTION

1. Field of the Invention

This invention relates to an electrical connection device using a terminal connector for establishing an electrical connection between tab or tab-shaped terminals.

2. Description of the Prior Art

A terminal connector is used hitherto for electrically connecting a bus bar to a male tab terminal of a fuse, a relay or the like in an electrical junction box. Such a terminal connector is disclosed in, for example, JP-A-58-27845 (UM).

The disclosed terminal connector is formed of a thin planar member of an electrical conductor which is bent at its both sides into the form of an arch thereby forming a pair of arch-shaped resilient contact strips opposing an electrical contact base.

A bus bar is bent at right angles at one of its end portions to form a tab-shaped terminal. This tab-shaped terminal of the bus bar is inserted from one direction into the space between the electrical contact base and the arch-shaped resilient contact strips of the terminal connector, and a mating male tab terminal of, for example, a fuse is inserted from the opposite direction into the internal space of the terminal connector to establish an electrical connection with the tab-shaped terminal of the bus bar. Because the tab-shaped terminal of the bus bar makes direct electrical contact with the male tab terminal of the fuse, a satisfactory electrical connection therebetween is established.

However, in the prior art terminal connector having the structure described above, the size (the width) of the male tab terminal of the fuse inserted into the space between the electrical contact base and the arch-shaped resilient contact strips of the terminal connector must necessarily be selected to be smaller than the width of the terminal connector. Therefore, the prior art terminal connector has been defective among others in that it is difficult to use this terminal connector in common to, for example, a blade type fuse and a fuse of the type standardized by the International Organization for standardization (ISO).

In an attempt to overcome the defect of the terminal connector referred to above, another terminal connector has been proposed. Such a terminal connector is disclosed in, for example, JP-B2-60-11588 (UM).

The disclosed terminal connector is formed of a thin planar member of an electrical conductor which is bent at about the middle to provide a generally U-like structure. This U-like structure is bent inwardly at one of its end portions to form a resilient contact strip, and its other end portion providing an electrical contact base is bent at its both sides inwardly to form a pair of arch-shaped contact strips similar to those of the prior art example described already.

A male tab terminal of, for example, a fuse and a mating tab-shaped terminal of a bus bar are inserted between the resilient contact strip and the electrical contact base and between the electrical contact base and the arch-shaped resilient contact strips of the terminal connector, respectively.

The latter example of the prior art terminal connector is advantageous over the former example in that the width of the male tab terminal of the fuse can be freely selected. However, in the latter terminal connector, the male tab terminal of the fuse is electrically connected with the mating tab-shaped terminal of the bus bar through the electrical contact base of the terminal connector. Therefore, the latter terminal connector has been defective in that, when those terminals do not make sufficient electrical contact with the electrical contact base, an undesirable increase in the contact resistance accompanying generation of considerable heat occurs, resulting in impossibility of establishing a satisfactory electrical connection.

SUMMARY OF THE INVENTION

It is therefore an object of the present invention to provide an electrical connection device which minimizes an undesirable increase in the contact resistance accompanying generation of heat and in which the type, that is, the size (the width) of a connectable tab terminal of a fuse or the like can be freely selected.

In accordance with the present invention which attains the above object, there is provided an electrical connection device comprising a terminal connector including a terminal guide, a resilient strip formed continuous to the terminal guide to be located opposite to one of the surfaces of the terminal guide, and a terminal support located opposite to the other surface of the terminal guide; a tab-shaped terminal of a bus bar to be electrically connected with the resilient strip; and a tab terminal of a fuse to be electrically connected with the terminal support, the tab-shaped terminal of the bus bar being formed with at least one electrical-contact purpose surface projection projecting toward the terminal guide of the terminal connector, and the terminal guide of the terminal connector being formed with a cutout for receiving the surface projection and permitting outward protrusion of th surface projection toward the terminal guide, whereby the surface projection of the tab-shaped terminal of the bus bar makes direct electrical contact with the tab terminal of the fuse.

In the electrical connection device of the present invention having the structure described above, the electrical-contact purpose surface projection formed on one of the terminals projects from the cutout of the terminal guide to make direct electrical contact with the other terminal. Therefore, an undesirable increase in the contact resistance accompanying generation of heat can be minimized in the electrical connection device of the present invention.

Also, because the terminal guide is disposed between the resilient strip and the terminal support, two terminals having different sizes, that is, different widths can be inserted into the gap between the resilient strip and the terminal support to be directly electrically connected with each other. Therefore, the size of these two terminals need not be limited.

DESCRIPTION OF THE PREFERRED EMBODIMENTS

Figure 1:
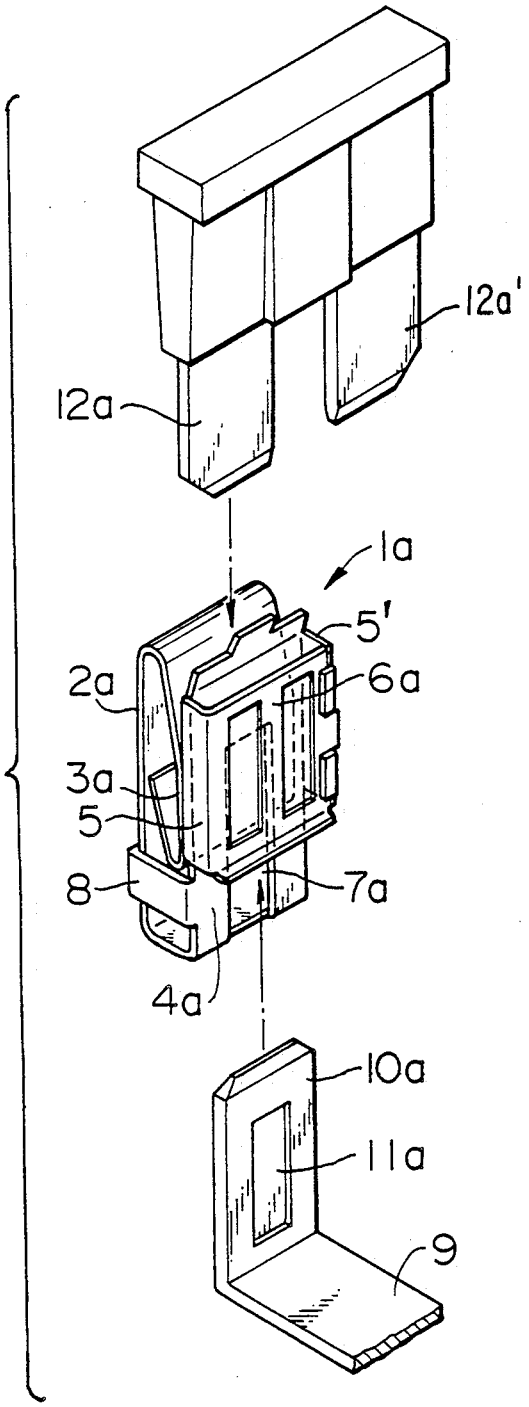
FIG. 1 is an exploded perspective view showing the structure of an embodiment of the electrical connection device according to the present invention.

FIG. 1 is an exploded perspective view of an embodiment of the electrical connection device according to the present invention. In FIG. 1, a terminal connector generally designated by the reference numeral 1a is shown in a state before a tab terminal 12a or 12a' of a fuse is inserted from its upper opening, and a mating tab-shaped terminal 10a of a bus bar 9 is inserted from its lower opening.

Referring to FIG. 1, the terminal connector 1a is formed of a flexible thin planar member 2a of a metal or a synthetic resin. The flexible thin planar member 2a is bent into a generally U-like shape at about the middle of its length.

One end portion of the U-like bent member 2a is bent inwardly, and the free end portion of the inwardly bent portion is further folded back to form a resilient strip 3a. The other end portion of the U-like bent member 2a is bent to extend upright in parallel to the resilient strip 3a to form a terminal guide 4a opposing the resilient strip 3a. Side walls 5 and 5' extending at right angles from both sides of the terminal guide 4a are provided, and the side wall 5 is then bent at right angles and extended to be coupled to the other side wall 5' thereby forming a terminal support 6a. The combination of the terminal guide 4a and the terminal support 6a constitutes a terminal holder. A gap permitting insertion of the two terminals 12a or 12a' and 10a is defined between the terminal holder and the resilient strip 3a, and the upper and lower ends of this gap provide the terminal insertion openings respectively.

The terminal guide 4a is formed with a cutout 7a extending in the longitudinal direction from its lower end. A pair of reinforcing strips 8 are provided adjacent to the lower end of the terminal guide 4a.

A bus bar 9 has its inserting end portion bent at right angles to form the tab-shaped terminal 10a. This tab-shaped terminal 10a is formed with a rectangular surface projection 11a shaped as by pressing with a press so as to make electrical contact with the mating tab terminal 12a or 12a' of the fuse.

Figure 2:
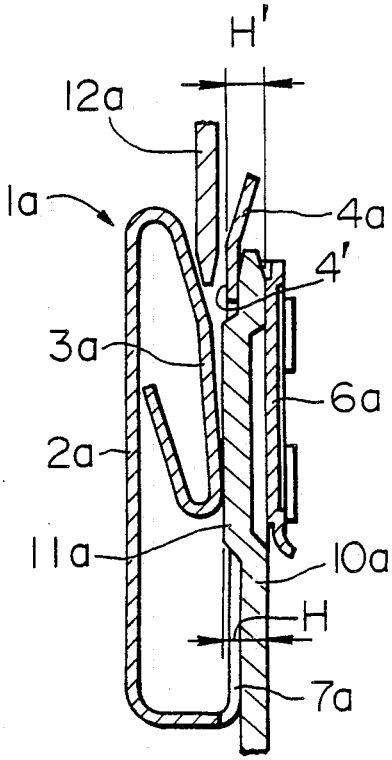
FIG. 2 is a longitudinal sectional view of the electrical connection device to show the state of electrical connection between two terminals inserted into the terminal connector.

FIG. 2 is a longitudinal sectional view of the electrical connection device to show that the tab-shaped terminal 10a of the bus bar 9 is inserted from the lower insertion opening of the terminal connector 1a.

The height H of the surface projection 11a of the tab-shaped terminal 10a of the bus bar 9 is selected to be larger than the distance H' between the inner surface of the terminal support 6a and the surface 4' of the terminal guide 4a opposing the resilient strip 3a, so that the surface projection 11a of the tab-shaped terminal 10a of the bus bar 9 inserted from the lower insertion opening of the terminal connector 1a can make direct electrical contact with the tab terminal 12a of the fuse inserted from the upper insertion opening defined between the resilient strip 3a and the terminal guide 4a.

Figure 3:
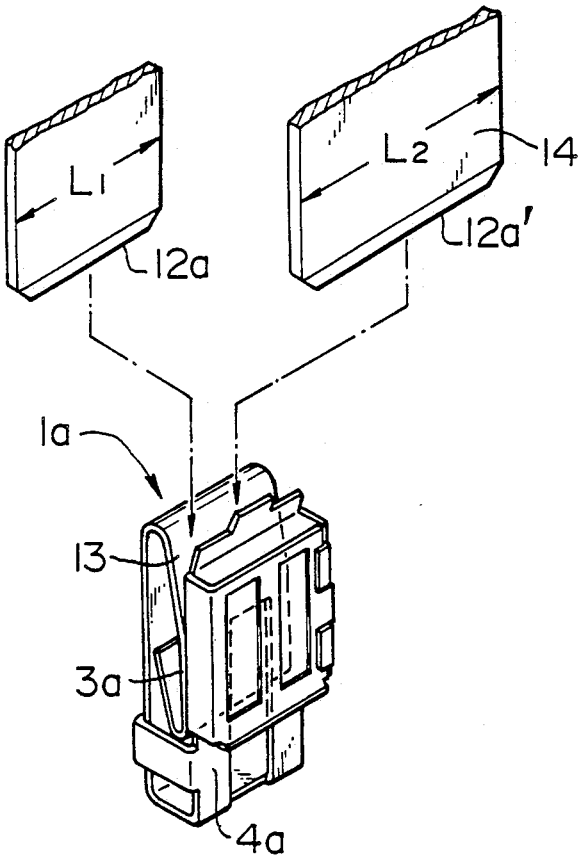
FIG. 3 illustrates that one of the two terminals to be electrically connected with the other terminal in the terminal connector may have a width different from that of the latter terminal.

FIG. 3 illustrates that either of the tab terminal 12a of the fuse of, for example, the blade type having a width $L_1$ and the tab terminal 12a' of the fuse of, for example, the type meeting the ISO standards and having a width $L_2(L_2>L_1)$ is applicable to the terminal connector 1a used in the device embodying the present invention.

This is because any obstacle obstructing free insertion of either the tab terminal 12a or the tab terminal 12a' is not present in the terminal insertion space 13 between the resilient strip 3a and the terminal guide 4a of the terminal connector 1a. Therefore, the electrical contact part 14 of the tab terminal 12a' having the larger width $L_2$ can be smoothly inserted to be directly electrically connected with the tab-shaped terminal 10a of the bus bar 9, although the tab terminal 12a' protrudes partly to the outside of the terminal connector 1a due to its large width $L_2$.

Figure 4:
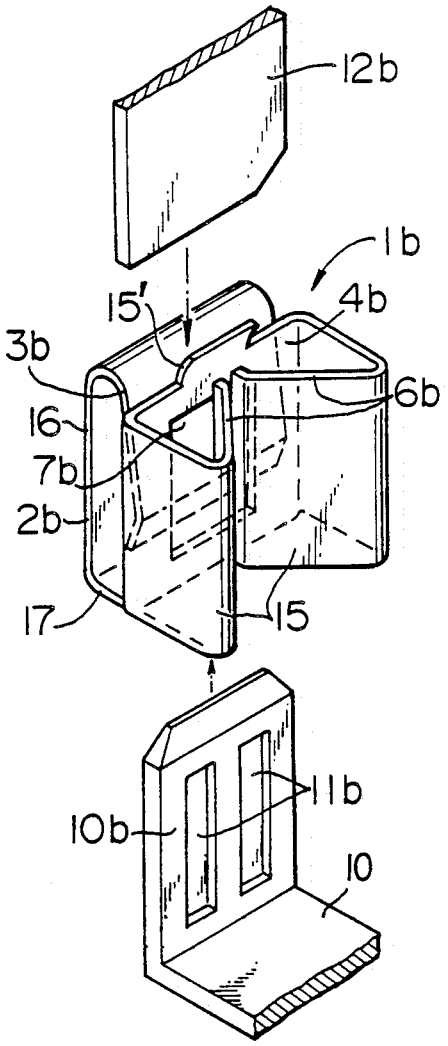
FIGS. 4, 5 and 6 are exploded perspective views of other embodiments of the electrical connection device according to the present invention.
Figure 5:
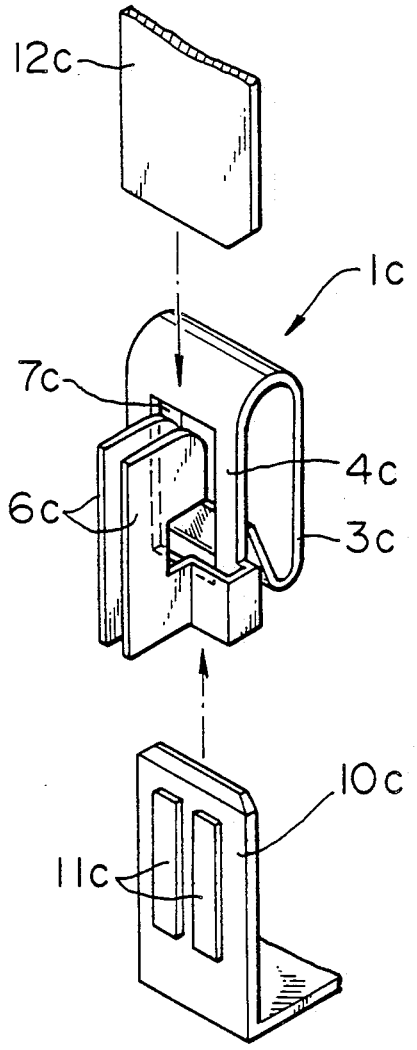
Figure 6:
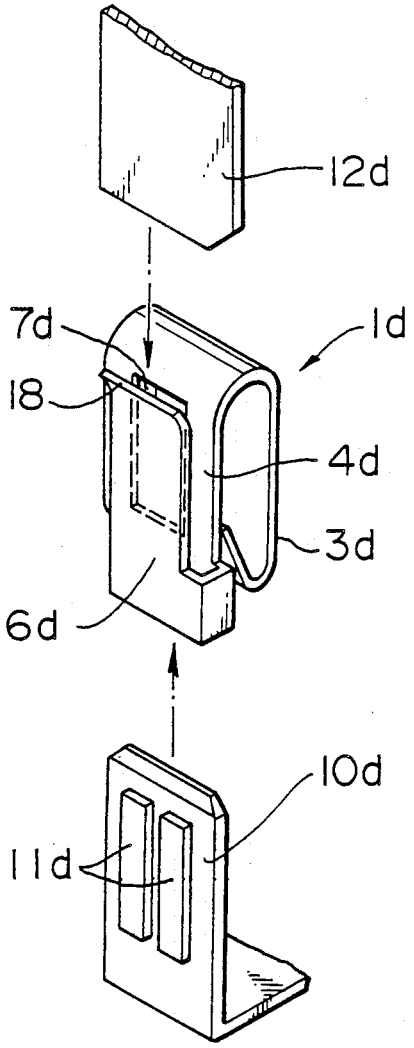

FIGS. 4, 5 and 6 are exploded perspective views of other embodiments of the electrical connection device according to the present invention.

A terminal connector 1b used in the device shown in FIG. 4 is formed by bending a thin planar member 2b. When this terminal connector 1b is developed on a plane, the shape of the thin planar member 2b before being bent is generally analogous to a T. That is, the initial shape is analogous to the state when a man extends his both arms. Arm-like strips 15 correspond to the both arms, and a cutout 7b is provided in the middle of a terminal guide 4b which is connected between these arm-like strips 15. The arm-like strips 15 are bent toward each other into the form of generally triangular prisms thereby forming a pair of resilient terminal supports 6b. A curved guide strip 15' projects from the upper end of the terminal guide 4b.

The body portion 16 of the thin planar member 2b is bent at right angles with respect to the terminal guide 4b thereby forming a connection strip 17. The substantial portion of this connection strip 17 is then bent in parallel to the terminal guide 4b, and the free end portion of the bent portion of the connection strip 17 is then folded back into the form of a U thereby forming a resilient strip 3b.

In FIG. 4, a bus bar has a tab-shaped terminal 10b, and two surface projections 11b are formed in parallel to each other on the tab-shaped terminal 10b for making electrical contact with a tab terminal 12b of a fuse.

In FIG. 4, the tab-shaped terminal 10b of the bus bar 10 is inserted between the terminal guide 4b and the terminal supports 6b until the electrical-contact purpose surface projections 11b fit in the cutout 7b, so that the tab-shaped terminal 10b of the bus bar makes direct electrical contact with the tab terminal 12b of the fuse inserted between the resilient strip 3b and the terminal guide 4b.

According to the embodiment shown in FIG. 4, the two terminals 10b and 12b make firm electrical contact with each other because the terminal supports 6b have a resiliency similar to that of the resilient strip 3b.

In a terminal connector 1c used in the device shown in FIG. 5, one end portion of a terminal guide 4c having a cutout 7c is bent into the form of a U, and its bent portion is then folded back to form a resilient strip 3c, and a pair of parallel or opposing terminal supports 6c extend from both sides of the other end portion of the terminal guide 4c. These terminal supports 6c extending in the longitudinal direction make right angles with respect to the terminal guide 4c and have a resiliency in the direction of the terminal guide 4c.

The embodiment shown in FIG. 5 differs from those shown in FIGS. 3 and 4 in that a tab-shaped terminal 10c of a bus bar is inserted between the resilient strip 3c and the terminal guide 4c, while a tab terminal 12c of a fuse is inserted between the terminal guide 4c and terminal supports 6c.

A terminal connector 1*d* used in the device shown in FIG. 6 is a modification of the terminal connector 1*c* shown in FIG. 5. That is, the structure of the terminal supports 6*c* in FIG. 5 is modified.

Referring to FIG. 6, the other end portion of a terminal guide 4*d* is connected with one end portion of a terminal support 6*d* extending in parallel to the terminal guide 4*d*, and the free end portion of the terminal support 6*d* is bent outwardly to form a guide 18. As in the case of the embodiment shown in FIG. 5, the terminal support 6*d* has a resiliency in the direction of the terminal guide 4*d*. Therefore, even when the thickness of a tab terminal 12*d* of a fuse and that of a tab-shaped terminal 10*d* of a bus bar may slightly deviate from the standard dimensions, the resiliency of the terminal support 6*d* ensures satisfactory electrical contact between the two terminals 12*d* and 10*d*.

In all of the aforementioned embodiments, the surface projections 11*a*, 11*b*, 11*c* and 11*d* for electrical contact purpose are provided on the tab terminals 10*a*, 10*b*, 10*c* and 10*d* respectively of the bus bars. It is apparent however that these surface projections 11*a*, 11*b*, 11*c* and 11*d* may be provided on the tab terminals 12*a*, 12*b*, 12*c* and 12*d* respectively of the fuses or may be provided on both of the bus bars and fuses. The essential requirement is that a surface projection having a height larger than the thickness of each of the terminal guides 4*a*, 4*b*, 4*c* and 4*d* is to be provided on each of the tab terminals 10*a*, 10*b*, 10*c* and 10*d* so as to ensure direct electrical contact with each of the tab-shaped terminals 12*a*, 12*b*, 12*c* and 12*d* respectively.

It will be understood from the foregoing description that the present invention provides an electrical connection device using a terminal connector in which a cutout is provided in a terminal guide, while at least one surface projection for electrical contact purpose is provided on one of two terminals, and this surface projection is received in the cutout so as to ensure direct electrical contact with the other terminal. Therefore, an undesirable increase in the electrical contact resistance accompanying undesirable generation of heat can be minimized thereby improving the reliability of the electrical connection between the two terminals.

Further, the electrical connection device of the present invention, in which the terminal guide is interposed between a resilient strip and a terminal support, is advantageous in that it is applicable to a variety of kinds of tab-shaped terminals having different widths.

What is claimed is:

1. An electrical connection device comprising:

a terminal connector including a terminal guide, a resilient strip formed continuous to said terminal guide to be located opposite to one of the surfaces of said terminal guide, and a terminal support located opposite to the other surface of said terminal guide a tab-shaped terminal of a bus bar to be electrically connected with said resilient strip; and a tab terminal of a fuse to be electrically connected with said terminal support; characterized, in that said tab-shaped terminal of the bus bar being formed with at least one electrical-contact surface projection projecting toward said terminal guide of said terminal connector, and said terminal guide of said terminal connector being formed with a cutout for receiving said surface projection and permitting outward protrusion of said surface projection toward said terminal guide, whereby said surface projection of said tab-shaped terminal of the bus bar makes direct electrical contact with said tab terminal of the fuse.

2. An electrical connection device according to claim 1, wherein the thickness of said terminal guide is selected to be smaller than the height of said surface projection provided on one of said terminals.

* * * * *